US012397343B2

(12) United States Patent
Aizawa et al.

(10) Patent No.: US 12,397,343 B2
(45) Date of Patent: Aug. 26, 2025

(54) MOLD COOLING DEVICE, CAST MANUFACTURING SYSTEM, AND CAST MANUFACTURING METHOD

(71) Applicants: TPR CO., LTD., Tokyo (JP); TPR INDUSTRY CO., LTD., Yamagata (JP)

(72) Inventors: Hideki Aizawa, Yamagata (JP); Atsushi Igarashi, Yamagata (JP)

(73) Assignees: TPR CO., LTD., Tokyo (JP); TPR INDUSTRY CO., LTD., Sagae (JP)

( * ) Notice: Subject to any disclaimer, the term of this patent is extended or adjusted under 35 U.S.C. 154(b) by 164 days.

(21) Appl. No.: 18/363,342

(22) Filed: Aug. 1, 2023

(65) Prior Publication Data

US 2023/0372999 A1 Nov. 23, 2023

Related U.S. Application Data

(63) Continuation of application No. PCT/JP2021/007620, filed on Mar. 1, 2021.

(51) Int. Cl.
*B22D 13/10* (2006.01)
*B22D 13/12* (2006.01)

(52) U.S. Cl.
CPC ..... *B22D 13/105* (2013.01); *B22D 13/12* (2013.01)

(58) Field of Classification Search
CPC ..... B22D 13/10; B22D 13/105; B22D 13/12
USPC ..... 164/114, 118, 272, 286, 289, 290, 296, 164/297
See application file for complete search history.

(56) References Cited

FOREIGN PATENT DOCUMENTS

JP H10-258344 A 9/1998
WO WO 2015053179 A1 * 4/2015 ..... B22C 9/065

OTHER PUBLICATIONS

Machine translation of WO 2015053179 A1 (Year: 2015).*

* cited by examiner

*Primary Examiner* — Kevin P Kerns
(74) *Attorney, Agent, or Firm* — PROCOPIO, CORY, HARGREAVES & SAVITCH LLP

(57) ABSTRACT

A cooling device (21) includes radiation thermometers (51 to 55), a plurality of nozzle parts, a plurality of electromagnetic valves ($V_1$ to $V_5$), and a control device (60). The radiation thermometers detect pre-cooling temperatures that are temperatures at a plurality of places on the mold before cooling water is sprayed from the plurality of nozzle parts to the mold. The control device individually sets a cooling time to each of the plurality of places on the mold based on a deviation between the pre-cooling temperature at the place on the mold and a target temperature and controls the electromagnetic valves based on the cooling times individually set to the plurality of respective places on the mold.

6 Claims, 8 Drawing Sheets

MOLD COOLING DEVICE, CAST MANUFACTURING SYSTEM, AND CAST MANUFACTURING METHOD

CROSS-REFERENCE TO RELATED APPLICATION

The present application is a bypass continuation application based on and claims the benefit of priority from PCT Application No. PCT/JP2021/007620 filed Mar. 1, 2021, the entire contents of which are incorporated herein by reference.

TECHNICAL FIELD

The present disclosure relates to a mold cooling device, a cast manufacturing system, and a cast manufacturing method.

BACKGROUND ART

A centrifugal casting method has been known as a method for shaping a cylindrical cast. The centrifugal casting method is a method of pouring molten metal into a cylindrical mold while rotating the mold, thereby pressurizing the molten metal with centrifugal force and shaping a cylindrical cast on the inner periphery of the mold. In a manufacturing process using such a centrifugal casting method, coating called mold wash is applied to the inner peripheral surface of the mold before the molten metal is poured into the mold, in order to achieve protection of the mold against heat of the molten metal, casting surface improvement, releasability improvement, burn-in prevention, and the like. Specifically, a preheating process of preheating the mold, a cooling process of adjusting the preheated mold to a temperature suitable for mold wash, and a lining process of applying the mold wash to the inner peripheral surface of the cooled mold by spraying or the like are sequentially performed as pretreatment processes of the molten metal pouring process of pouring the molten metal into the mold.

In such a centrifugal casting method, the quality of the mold wash is determined by the temperature of the mold when the mold wash is applied to the inner peripheral surface of the mold. Thus, in the cooling process, it is important to cool the temperature of the preheated mold to a target temperature suitable for mold wash application. Conventional examples of such a mold cooling method include a method disclosed in Patent Literature 1 below.

In the cooling method disclosed in Patent Literature 1, a spray device that is inserted into a mold and sprays cooling water to the inner peripheral surface of the mold is used. The spray device is provided with a thermometer capable of detecting temperature at the inner peripheral surface of the mold. In the cooling method disclosed in Patent Literature 1, first, temperature at each of a plurality of sites on the inner peripheral surface of the mold is sequentially measured by the thermometer while the spray device is moved in an axial direction of the mold. Thereafter, the spraying amount of cooling water and the moving speed of the spray device at each site are set based on the deviation between the temperature measured at the site by the thermometer and a target temperature. Then, the set spraying amount of cooling water is sequentially sprayed from the spray device to each site while the spray device is moved at the set moving speed.

CITATION LIST

Patent Literature

Patent Literature 1: Japanese Patent Laid-open No. 10-258344

SUMMARY OF INVENTION

Technical Problem

In the cooling device disclosed in Patent Literature 1, cooling water is sequentially sprayed to a plurality of sites on the inner peripheral surface of a mold. Thus, a time lag occurs between the timings of spraying cooling water to the plurality of sites. These time lags cause variance in temperature distribution of the cooled mold and potentially degrade the quality of mold wash.

The present disclosure is intended to provide a mold cooling device, a cast manufacturing system, and a cast manufacturing method that are capable of more uniformly cooling a mold.

Solution to Problem

A mold cooling device according to an aspect of the present disclosure is a cooling device configured to cool a cylindrical mold used for centrifugal casting and includes a temperature detection unit, a plurality of spraying units, a plurality of switching units, and a control unit. The temperature detection unit detects temperatures at a plurality of respective places on the mold. The plurality of spraying units are disposed alongside in a direction parallel to a central axis of the mold and spray cooling water to the mold. The plurality of switching units switch between spraying of the cooling water from the plurality of spraying units and stop of the spraying. The control unit controls the plurality of switching units. The temperature detection unit detects pre-cooling temperatures that are temperatures at the plurality of respective places on the mold before the cooling water is sprayed from the plurality of spraying units to the mold. When a cooling time is a time from a time point at which the cooling water is sprayed from the spraying units to a time point at which the spraying of the cooling water is stopped, the control unit individually sets the cooling time to each of the plurality of places on the mold based on a deviation between the pre-cooling temperature detected at the place on the mold by the temperature detection unit and a target temperature and controls the plurality of switching units based on the cooling times individually set to the plurality of respective places on the mold.

With this configuration, it is possible to individually manage the cooling times of the plurality of respective places on the mold while simultaneously spraying the cooling water from the plurality of spraying units. Accordingly, it is possible to individually control the degrees of cooling at the plurality of places on the mold, and thus it is possible to more uniformly cool the mold.

The above-described cooling device may further include a cooling water supplying tube that supplies the cooling water to the plurality of spraying units, the cooling water supplying tube may include a main pipe through which the cooling water flows and a plurality of bifurcation pipes bifurcated from the main pipe and supplying the cooling water to the plurality of respective spraying units, and the plurality of switching units may be provided at the plurality of respective bifurcation pipes.

With this configuration, it is possible to easily achieve a configuration for spraying the cooling water from the plurality of spraying units.

In the above-described cooling device, the temperature detection unit may further detect post-cooling temperatures that are temperatures at the plurality of respective places on the mold after the cooling water is sprayed from the plurality of spraying units to the mold, and the control unit may set correction parameters based on the post-cooling temperatures detected at the plurality of respective places on the mold by the temperature detection unit and may correct the cooling times individually set to the plurality of respective places on the mold with the correction parameters.

With this configuration, it is possible to perform feedback correction of the cooling times, and thus it is possible to more accurately adjust the temperature of a mold flowing next closer to the target temperature.

In the above-described cooling device, when the post-cooling temperature at a predetermined place among the plurality of places on the mold is higher than a predetermined temperature range determined based on the target temperature, the control unit may set the correction parameters so that the cooling time corresponding to the predetermined place is corrected to be longer, and when the post-cooling temperature at the predetermined place on the mold is lower than the predetermined temperature range, the control unit may set the correction parameters so that the cooling time corresponding to the predetermined place is corrected to be shorter.

A cast manufacturing system according to another aspect of the present disclosure is a cast manufacturing system configured to manufacture a cylindrical cast by using a centrifugal casting method and includes a cooling device configured to cool the mold, a lining device configured to apply mold wash to the cooled mold, a molten metal pouring device configured to pour molten metal into the mold to which the mold wash is applied, a conveyance device configured to convey the mold, and a control device configured to control the conveyance device. The above-described cooling device is used as the cooling device. A lower limit temperature threshold value is set as a temperature lower than a lower limit value of the predetermined temperature range, and an upper limit temperature threshold value is set as a temperature higher than an upper limit value of the predetermined temperature range. When the post-cooling temperature at each of the plurality of places on the mold is equal to or higher than the lower limit temperature threshold value and equal to or lower than the upper limit temperature threshold value, the control device of the conveyance device conveys the mold to the lining device by using the conveyance device, and when the post-cooling temperature at any of the plurality of places on the mold is lower than the lower limit temperature threshold value or when the post-cooling temperature at any of the plurality of places on the mold is higher than the upper limit temperature threshold value, the control device of the conveyance device detects temperature anomaly of the mold.

A cast manufacturing method according to another aspect of the present disclosure is a cast manufacturing method of manufacturing a cylindrical cast by using a centrifugal casting method and includes a cooling process of cooling a mold, a lining process of applying mold wash to the cooled mold, and a molten metal pouring process of pouring molten metal into the mold to which the mold wash is applied. The cooling process is performed by using the above-described cooling device. A lower limit temperature threshold value is set as a temperature lower than a lower limit value of the predetermined temperature range, and an upper limit temperature threshold value is set as a temperature higher than an upper limit value of the predetermined temperature range. Processes performed after the cooling process is completed include a conveyance process of conveying the mold to the lining process when the post-cooling temperature at each of the plurality of places on the mold is equal to or higher than the lower limit temperature threshold value and equal to or lower than the upper limit temperature threshold value, and an anomaly detection process of detecting temperature anomaly of the mold when the post-cooling temperature at any of the plurality of places on the mold lower than the lower limit temperature threshold value or when the post-cooling temperature at any of the plurality of places on the mold is higher than the upper limit temperature threshold value.

With the system and the method, it is possible to detect temperature anomaly of the mold when the temperature of the mold after cooling is too low or too high, and thus it is possible to more accurately manage the temperature of the mold proceeding to postprocessing of the cooling device.

DESCRIPTION OF EMBODIMENT

Figure 1:
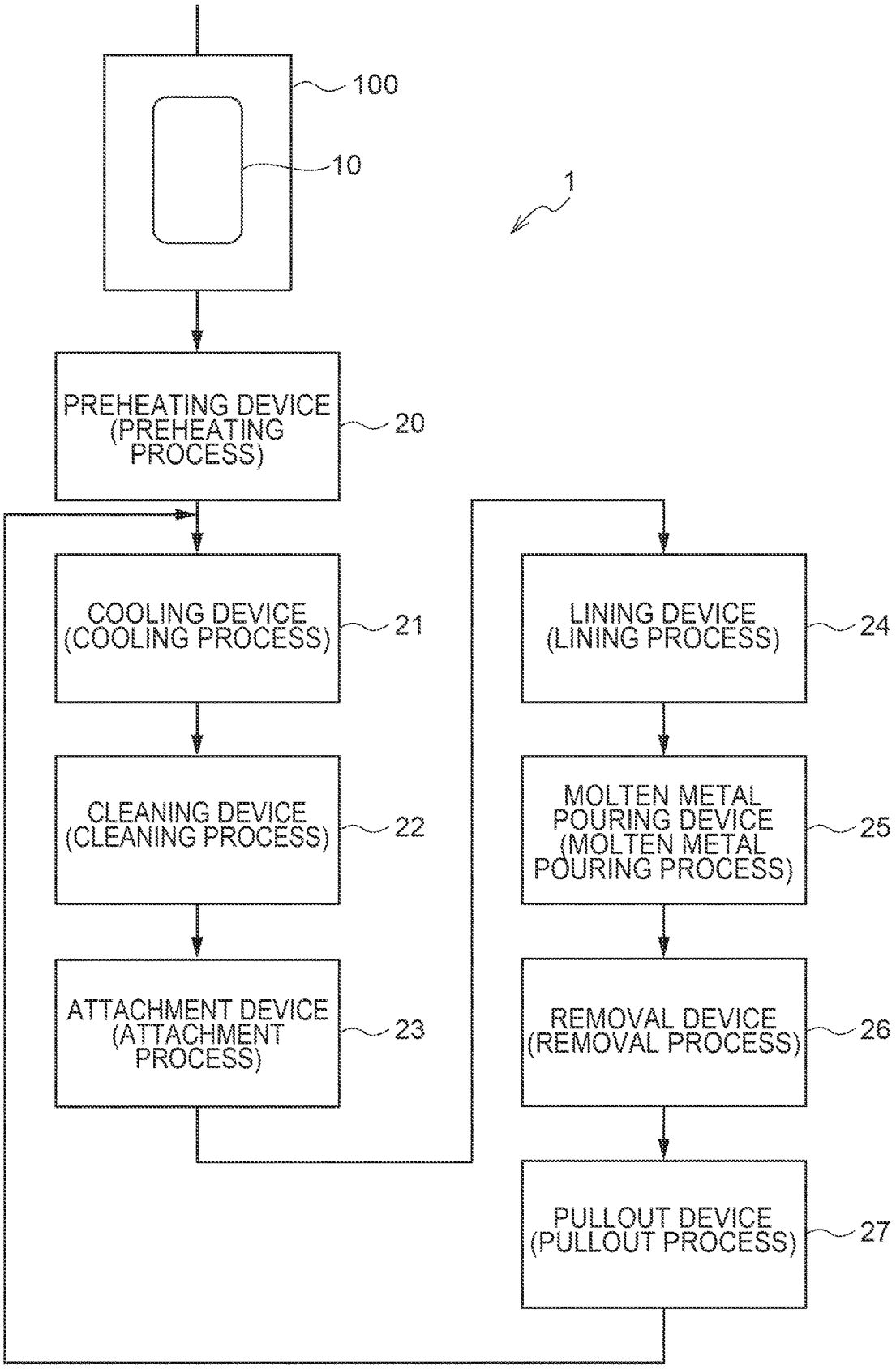
FIG. 1 is a block diagram illustrating a schematic configuration of a manufacturing system according to an embodiment.

An embodiment of a mold cooling device, a cast manufacturing system, and a cast manufacturing method will be described below with reference to the accompanying drawings. To facilitate understanding of the description, any identical constituent components in the drawings are denoted by the same reference sign when possible, and duplicate description thereof is omitted.

FIG. 1 illustrates a schematic configuration of a manufacturing system 1 configured to shape a cylindrical cast by a centrifugal casting method. The cast manufactured by the manufacturing system 1 is, for example, a cylinder liner. A cylindrical mold 10 as illustrated in FIG. 2 is used in the manufacturing system 1.

Figure 2:
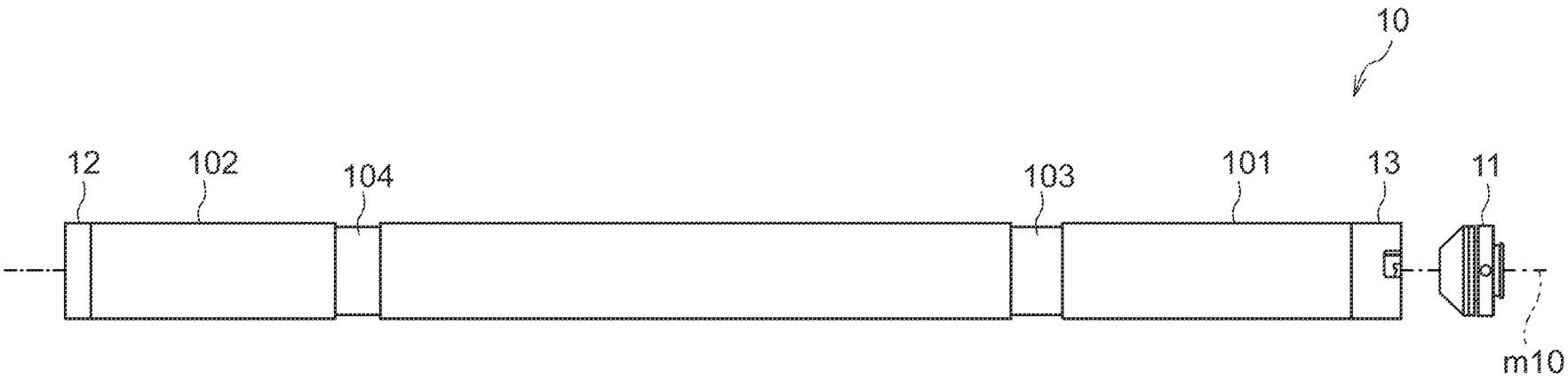
FIG. 2 is a front view illustrating a front-view structure of a mold according to the embodiment.

As illustrated in FIG. 2, a mold 10 is formed in a cylindrical shape about an axis line m10. Hereinafter, the axis line m10 is also referred to as a "central axis m10". An annular mounting part 13 is fixed at a one end part 101 of the mold 10. A lid member 11 is mounted on the mounting part 13 in a demountable manner. The other end part 102 of the mold 10 is blocked by a lid member 12. A through-hole communicating with the internal space of the mold 10 is formed through each of the lid members 11 and 12.

In the manufacturing system 1 illustrated in FIG. 1, the mold 10 from which the lid member 11 is removed is preheated by a preheating device 20, and then the mold 10 is cooled by a cooling device 21. The cooling device 21 sprays cooling water to the mold 10, thereby decreasing the temperature of the mold 10 to a target temperature suitable for mold wash application. Thereafter, a cleaning device 22 cleans inside the mold 10 with a brush or the like to, for example, remove mold wash residue inside the mold 10. Subsequently, after the lid member 11 is mounted on the mounting part 13 of the mold 10 by an attachment device 23, mold wash is applied by spraying or the like to the inner peripheral surface of the mold 10 by a lining device 24. A molten metal pouring device 25 pours molten metal into the mold 10 through the through-hole of the lid member 12 while rotating the mold 10 to which the mold wash is applied. Subsequently, the mold 10 is cooled and the lid member 11 is removed from the mounting part 13 of the mold 10 by a removal device 26, and then a cast is pulled out of the mold 10 by a pullout device 27. Accordingly, shaping of the cast is completed.

After the cast is pulled out of the mold 10 in this manner, the mold 10 is used for shaping of the next cast. In this case, since the mold 10 is maintained in a high temperature state due to residual heat and waste heat of the molten metal pouring, the mold 10 is returned to the cooling device 21 and cooled.

As described above, a manufacturing process according to the present embodiment sequentially performs the preheating process, the cooling process, the cleaning process, the attachment process, the lining process, the molten metal pouring process, the removal process, and the pullout process, and then returns to the cooling process to repeatedly perform the processes of the cooling process to the pullout process.

A conveyance device 100 configured to convey a plurality of molds 10 is used in the manufacturing system 1 according to the present embodiment, and cast mass production is achieved as the molds are sequentially conveyed to the devices 21 to 27 and the like by the conveyance device 100.

The structures of the mold 10 and the cooling device 21 according to the present embodiment will be described next in detail with reference to FIGS. 2 and 3.

As illustrated in FIG. 2, an insertion groove 103 extending in the circumferential direction of the outer peripheral surface of a site positioned at the midpoint between the one end part 101 and a central part of the mold 10 is formed at the outer peripheral surface. Similarly, an insertion groove 104 extending in the circumferential direction of the outer peripheral surface of a site positioned at the midpoint between the other end part 102 and the central part of the mold 10 is formed at the outer peripheral surface.

Figure 3:
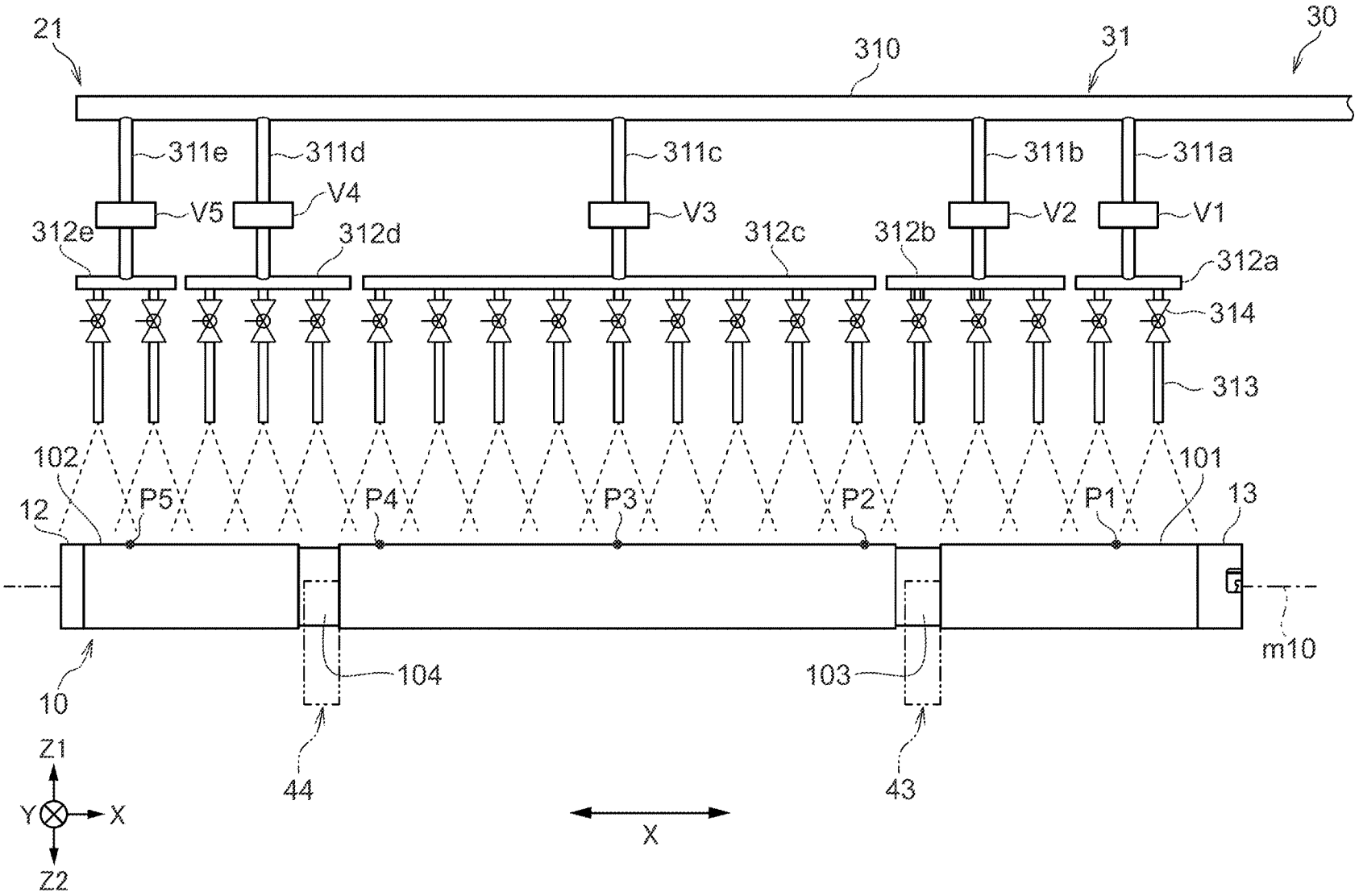
FIG. 3 is a front view illustrating a front-view structure of a cooling water spray device and a roller device according to the embodiment.

As illustrated in FIG. 3, the mold 10 is disposed in the cooling device 21 such that the central axis m10 is parallel to an X direction. The X direction is a horizontal direction. Hereinafter, a direction parallel to the X direction is referred to as a "right-left direction".

Note that, in the drawing, a direction illustrated with an arrow Z1 indicates the upper side in the vertical direction, and a direction illustrated with an arrow Z2 indicates the lower side in the vertical direction. Hereinafter, the direction illustrated with the arrow Z1 is referred to as an "upper side", and the direction illustrated with the arrow Z2 is referred to as a "lower side".

The cooling device 21 includes a cooling water spray device 30 and rollers 43 and 44.

The cooling water spray device 30 includes a cooling water supplying tube 31 and electromagnetic valves $V_1$ to $V_5$.

The cooling water supplying tube 31 is disposed on the upper side of the mold 10. The cooling water supplying tube 31 includes a main pipe 310, a plurality of bifurcation pipes 311*a* to 311*e*, and a plurality of pipe portions 312*a* to 312*e*. In the present embodiment, the cooling water supplying tube 31 corresponds to a cooling medium supplying tube.

The main pipe 310 extends in the right-left direction. Cooling water having a predetermined water pressure is supplied to the main pipe 310 by a pump or the like.

The plurality of bifurcation pipes 311*a* to 311*e* are bifurcated from the main pipe 310 and extend downward toward the mold 10. The cooling water is supplied from the main pipe 310 to the bifurcation pipes 311*a* to 311*e*. The plurality of pipe portions 312*a* to 312*e* are attached to distal end parts of the plurality of respective bifurcation pipes 311*a* to 311*e*. The pipe portions 312*a* to 312*e* extend in the right-left direction. The first pipe portion 312*a* is positioned substantially on the upper side of the one end part 101 of the mold 10. The second pipe portion 312*b* is positioned substantially on the upper side of the insertion groove 103 of the mold 10. The third pipe portion 312*c* is positioned on the upper side of a substantially central part of the mold 10 in the right-left direction. The fourth pipe portion 312*d* is positioned substantially on the upper side of the insertion groove 104 of the mold 10. The fifth pipe portion 312*e* is positioned substantially on the upper side of the other end part 102 of the mold 10. The cooling water is supplied from the bifurcation pipes 311*a* to 311*e* to the respective pipe portions 312*a* to 312*e*.

The pipe portions 312*a* to 312*e* each include a plurality of nozzle parts 313. The plurality of nozzle parts 313 are disposed alongside in the right-left direction. The nozzle parts 313 extend from the pipe portions 312*a* to 312*e* toward the center of the mold 10. The pipe portions 312*a* to 312*e* each spray, from the nozzle parts 313 toward the mold 10, the cooling water supplied from the bifurcation pipes 311*a* to 311*e*. Thus, the nozzle parts 313 are parts of the pipe portions 312*a* to 312*e* from which the cooling water is actually sprayed. The interval of disposition of the nozzle parts 313 in the right-left direction is set in advance such that the cooling water is sprayed onto the entire mold 10. In the present embodiment, the nozzle parts 313 correspond to spraying units.

Each nozzle part 313 is provided with a ball valve 314. The opening degree of each ball valve 314 is manually changeable. The amount of the cooling water sprayed from each nozzle part 313 can be individually adjusted by changing the opening degree of the corresponding ball valve 314. For example, the amounts of the cooling water sprayed from two respective nozzle parts 313 provided at the first pipe portion 312*a* can be differentiated by individually adjusting the opening degrees of the ball valves 314 of the respective nozzle parts 313.

The electromagnetic valves $V_1$ to $V_5$ are provided at the respective bifurcation pipes 311*a* to 311*e*. The electromagnetic valves $V_1$ to $V_5$ open and close the respective bifurcation pipes 311*a* to 311*e* through opening and closing operations based on electric power supply. Specifically, when the electromagnetic valves $V_1$ to $V_5$ are closed, supply of the cooling water to the pipe portions 312*a* to 312*e* is stopped, and accordingly, the cooling water is not sprayed from the nozzle parts 313 to the mold 10. When the electromagnetic valves $V_1$ to $V_5$ are opened, the cooling water is supplied to the pipe portions 312*a* to 312*e*, and accordingly, the cooling water is sprayed from the nozzle parts 313 to the mold 10. In this manner, in the present embodiment, the electromagnetic valves $V_1$ to $V_5$ correspond to switching units configured to switch spraying states of the cooling water from the pipe portions 312*a* to 312*e* through the nozzle parts 313.

The rollers 43 and 44 are devices for rotating the mold 10. The rollers 43 and 44 each rotate based on power transferred from a non-illustrated motor or the like.

In the cooling device 21, two rollers 43 are disposed such that the rollers 43 face each other in a direction illustrated with an arrow Y. Similarly, two rollers 44 are disposed such that the rollers 44 face each other in the direction illustrated with the arrow Y. The direction illustrated with the arrow Y is a direction orthogonal to both the right-left and up-down directions. Hereinafter, the direction illustrated with the arrow Y is referred to as a "depth direction".

In the cooling device 21, the rollers 43 are inserted into the insertion groove 103 of the mold 10, and the rollers 44 are inserted into the insertion groove 104 of the mold 10. Accordingly, the mold 10 is supported by the rollers 43 and 44. In this state, as the rollers 43 and 44 rotate, the mold 10 rotates about the central axis m10.

In the cooling device 21, the cooling water is sprayed from the nozzle parts 313 toward the mold 10 when the electromagnetic valves $V_1$ to $V_5$ are opened while the mold 10 is rotating. The mold 10 is cooled as the cooling water absorbs heat of the mold 10. Thereafter, when the electromagnetic valves $V_1$ to $V_5$ are closed, spraying of the cooling water from the nozzle parts 313 stops and cooling of the mold 10 ends. In this manner, in the present embodiment, the cooling water corresponds to a cooling medium sprayed to a mold. Note that such a cooling medium may be an optional medium different from the cooling water.

Figure 4:
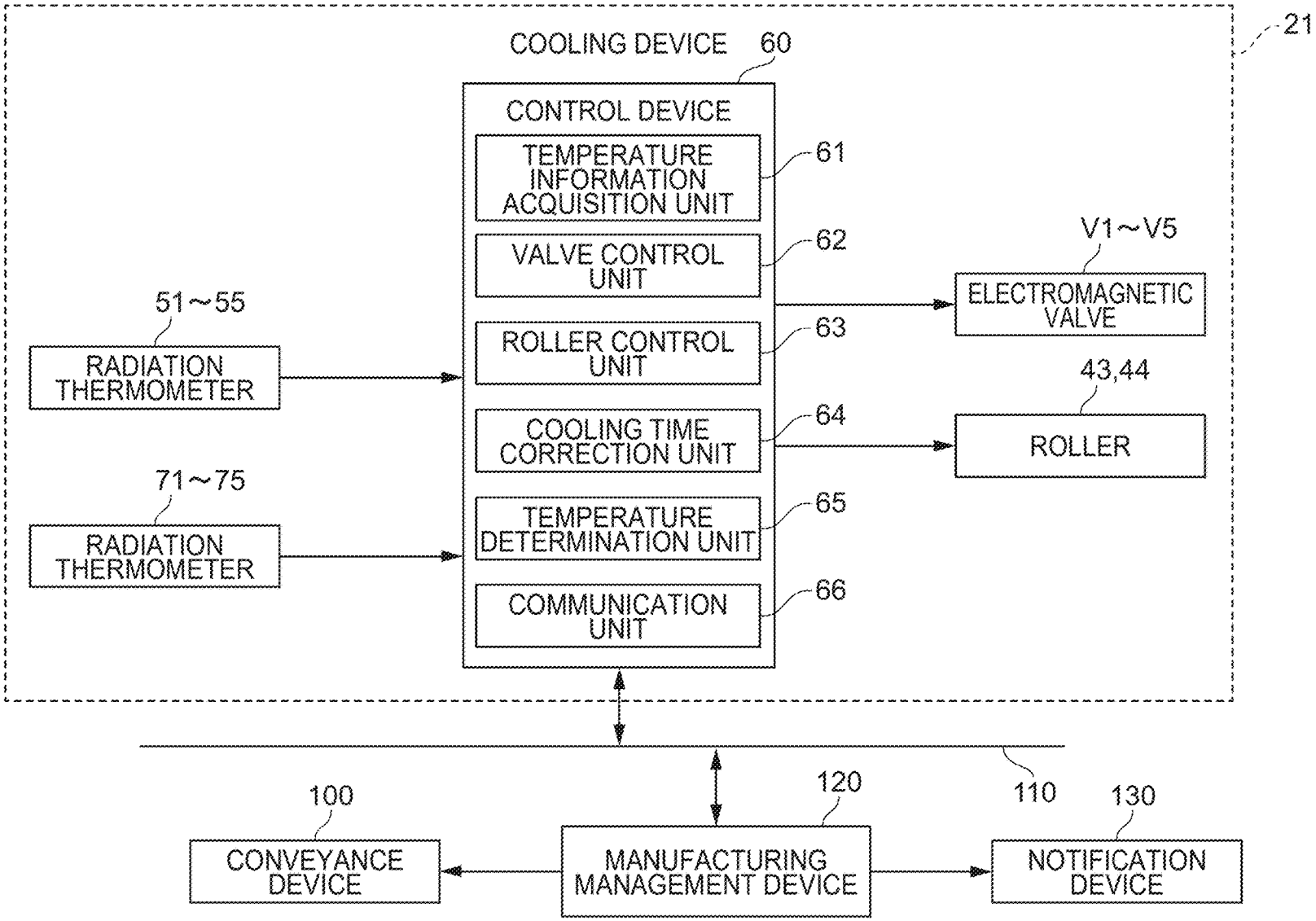
FIG. 4 is a block diagram illustrating a schematic configuration of a cooling device according to the embodiment.

As illustrated in FIG. 4, the cooling device 21 further includes radiation thermometers 51 to 55 and 71 to 75 and a control device 60.

Figure 5:
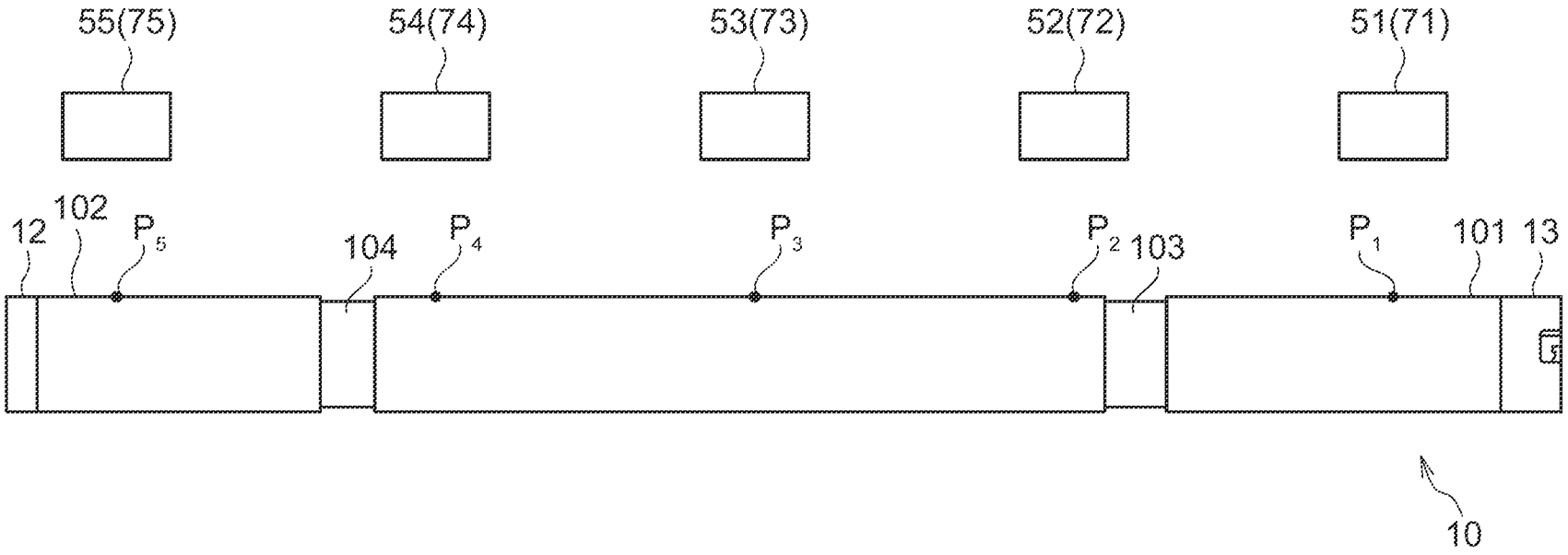
FIG. 5 is a front view illustrating the positional relation between the mold and each radiation thermometer according to the embodiment.

The radiation thermometers 51 to 55 and 71 to 75 are devices configured to measure the temperature of the mold 10 based on the intensity of infrared, visible light, or the like radiated from the mold 10. Specifically, as illustrated in FIG. 5, the radiation thermometers 51 to 55 and 71 to 75 measure temperatures at five respective places $P_1$ to $P_5$ set on the outer peripheral surface of the mold 10. Hereinafter, the places $P_1$ to $P_5$ on the mold 10 are referred to as "measurement points $P_1$ to $P_5$". In the present embodiment, the radiation thermometers 51 to 55 and 71 to 75 each correspond to a temperature detection unit.

The radiation thermometers 51 to 55 detect the temperature of the mold 10 at a time point before the cooling water is sprayed to the mold 10 preheated by the preheating device 20. The radiation thermometers 71 to 75 detect the temperature of the mold 10 at a time point after the cooling water is sprayed to the mold 10. In other words, the radiation thermometers 51 to 55 detect the temperature of the mold 10 before cooling, and the radiation thermometers 71 to 75 detect the temperature of the mold 10 after cooling.

Specifically, in a manufacturing process illustrated in FIG. 1, the mold 10 preheated by the preheating device 20 is conveyed to the disposition places of the radiation thermometers 51 to 55 by the conveyance device 100. Then, the radiation thermometers 51 to 55 detect temperatures $Tb_1$ to $Tb_5$ at the first to fifth measurement points $P_1$ to $P_5$, respectively on the mold 10. Hereinafter, the temperatures $Tb_1$ to $Tb_5$ are referred to as "pre-cooling temperatures $Tb_1$ to $Tb_5$". The pre-cooling temperatures $Tb_1$ to $Tb_5$ correspond to temperatures at the measurement points $P_1$ to $P_5$ before the cooling water is sprayed from the nozzle parts 313 illustrated in FIG. 3 to the mold 10.

The mold 10 for which the temperature measurement is completed is conveyed to the installation place of the cooling water spray device 30 illustrated in FIG. 3 by the conveyance device 100, and then is cooled by the cooling water sprayed from the cooling water spray device 30. The mold 10 for which the cooling is completed is conveyed to the disposition places of the radiation thermometers 71 to 75 by the conveyance device 100. Then, the radiation thermometers 71 to 75 detect temperatures $Ta_1$ to $Ta_5$ at the first to fifth measurement points $P_1$ to $P_5$ on the mold 10. Hereinafter, the temperatures $Ta_1$ to $Ta_5$ are referred to as "post-cooling temperatures $Ta_1$ to $Ta_5$". The post-cooling temperatures $Ta_1$ to $Ta_5$ correspond to temperatures at the measurement points $P_1$ to $P_5$ after the cooling water is sprayed from the nozzle parts 313 illustrated in FIG. 3 to the mold 10.

The control device 60 illustrated in FIG. 4 is mainly configured as a microcomputer including a processor, a storage unit, and the like. In the present embodiment, the control device 60 corresponds to a control unit. The control device 60 controls the electromagnetic valves $V_1$ to $V_5$ and the rollers 43 and 44 of the cooling water spray device 30 by executing a computer program stored the storage unit in advance. The control device 60 is connected to a manufacturing management device 120 to perform communication therebetween through a network 110 such as a local area network (LAN). The manufacturing management device 120 is a device configured to collectively manage a cast production line by controlling the conveyance device 100, a notification device 130, and the devices 20 to 27 illustrated in FIG. 1, and the like while managing the positions of a plurality of respective molds 10 flowing on the production line. The notification device 130 is a device for performing various kinds of notification such as notification of anomaly to a worker. In the present embodiment, the manufacturing management device 120 corresponds to a control device configured to control the conveyance device 100.

The control device 60 includes a temperature information acquisition unit 61, a valve control unit 62, a roller control unit 63, a cooling time correction unit 64, a temperature determination unit 65, and a communication unit 66 as functional elements each achieved as a computer program stored in the storage unit is executed by the processor.

The temperature information acquisition unit 61 acquires the temperatures at the first to fifth measurement points $P_1$ to $P_5$ on each mold 10 from the radiation thermometers 51 to 55 and 71 to 75. Specifically, the temperature information acquisition unit 61 acquires, as the temperatures at the first to fifth measurement points $P_1$ to $P_5$, information of the pre-cooling temperatures $Tb_1$ to $Tb_5$ and the post-cooling temperatures $Ta_1$ to $Ta_5$ described above.

The valve control unit 62 controls opening and closing of the electromagnetic valves $V_1$ to $V_5$ based on the pre-cooling temperatures $Tb_1$ to $Tb_5$ acquired by the temperature information acquisition unit 61. Specifically, the valve control unit 62 sets cooling times $CT_1$ to $CT_5$ corresponding to the first to fifth measurement points $P_1$ to $P_5$, respectively, on the mold 10 based on the pre-cooling temperatures $Tb_1$ to $Tb_5$. The cooling times $CT_1$ to $CT_5$ are each a time from a time point at which the corresponding one of the electromagnetic valves $V_1$ to $V_5$ of the cooling water spray device 30 is opened to a time point at which the valve is closed, in other words, a time from a time point at which the cooling water is sprayed from the nozzle parts 313 to a time point at which the spraying of the cooling water is stopped. The valve control unit 62 basically sets the cooling times $CT_1$ to $CT_5$ to be longer as the pre-cooling temperatures $Tb_1$ to $Tb_5$ are higher, and sets the cooling times $CT_1$ to $CT_5$ to be shorter as the pre-cooling temperatures $Tb_1$ to $Tb_5$ are lower. The valve control unit 62 controls the electromagnetic valves $V_1$ to $V_5$ based on the set cooling times $CT_1$ to $CT_5$, respectively.

The roller control unit 63 controls the rollers 43 and 44 illustrated in FIG. 3. Specifically, after the mold 10 is installed on the rollers 43 and 44, the roller control unit 63 continuously rotates the mold 10 by rotating the rollers 43 and 44 from a time point at which spraying of the cooling water from the cooling water spray device 30 is started to a time point at which the spraying of the cooling water is stopped.

The cooling time correction unit 64 corrects, based on the post-cooling temperatures $Ta_1$ to $Ta_5$ acquired by the temperature information acquisition unit 61, the cooling times $CT_1$ to $CT_5$ set to the mold 10 cooled after the current time point. In the present embodiment, a temperature suitable for mold wash application is determined for each of the measurement points $P_1$ to $P_5$ on the mold 10 by experiment or the like in advance, and these temperatures are stored as target temperatures $Tt_1$ to $Tt_5$ in the storage unit. The mold wash can be appropriately applied to the mold 10 when the temperatures at the measurement points $P_1$ to $P_5$ on the mold 10 cooled by the cooling device 21 are equal to the target temperatures $Tt_1$ to $Tt_5$. Note that the target temperatures $Tt_1$ to $Tt_5$ may be the same value or may be set to values different from each other. For example, since molten metal is poured into the mold 10 through the lid member 12 in the molten metal pouring process, the target temperatures $Tt_4$ and $Tt_5$ at the measurement points $P_4$ and $P_5$ may be set to values lower than the target temperature $Tt_1$ to $Tt_3$ at the measurement point $P_1$ to $P_3$.

The cooling time correction unit 64 determines cooling coefficients set for the cooling times $CT_1$ to $CT_5$, respectively, by comparing the post-cooling temperatures $Ta_1$ to $Ta_5$ with the target temperatures $Tt_1$ to $Tt_5$, respectively. For example, when the post-cooling temperature $Ta_1$ is too high for the target temperature $Tt_1$, the cooling time correction unit 64 sets the cooling coefficient of the cooling time $CT_1$ so that the cooling time $CT_1$ becomes longer. On the contrary, when the post-cooling temperature $Ta_1$ is too low for the target temperature $Tt_1$, the cooling time correction unit 64 sets the cooling coefficient of the cooling time $CT_1$ so that the cooling time $CT_1$ becomes shorter.

The temperature determination unit 65 determines whether the mold wash can be applied to the mold 10 based on the post-cooling temperatures $Ta_1$ to $Ta_5$ acquired by the temperature information acquisition unit 61. In the present embodiment, an appropriate temperature range in which the mold wash can be applied is determined by experiment or the like in advance, and an upper limit temperature threshold value and a lower limit temperature threshold value of the temperature range are stored in the storage unit. When any of the post-cooling temperatures $Ta_1$ to $Ta_5$ is lower than the lower limit temperature threshold value, the temperature determination unit 65 determines that the mold wash cannot be applied to the mold 10 because of low temperature. When any of the post-cooling temperatures $Ta_1$ to $Ta_5$ is higher than the upper limit temperature threshold value, the temperature determination unit 65 determines that the mold wash cannot be applied to the mold 10 because of high temperature.

The communication unit 66 is a part through which various kinds of information are transmitted to and received from the manufacturing management device 120. For example, when the temperature determination unit 65 has determined that the mold wash cannot be applied to the mold 10 because of low temperature or high temperature, the communication unit 66 notifies the manufacturing management device 120 of the determination. When notified that the mold wash cannot be applied to the mold 10 because of low temperature, the manufacturing management device 120 detects that the temperature of the mold 10 is anomalous on the low temperature side, and performs notification to the worker or the like. When notified that the mold wash cannot be applied to the mold 10 because of high temperature, the manufacturing management device 120 detects that the temperature of the mold 10 is anomalous on the high temperature side, and performs notification to the worker or the like.

Control of the electromagnetic valves $V_1$ to $V_5$ executed by the control device 60 will be specifically described next with reference to FIGS. 6 and 7. Note that processing illustrated in FIGS. 6 and 7 is repeatedly executed in a predetermined period by the control device 60.

Figure 6:
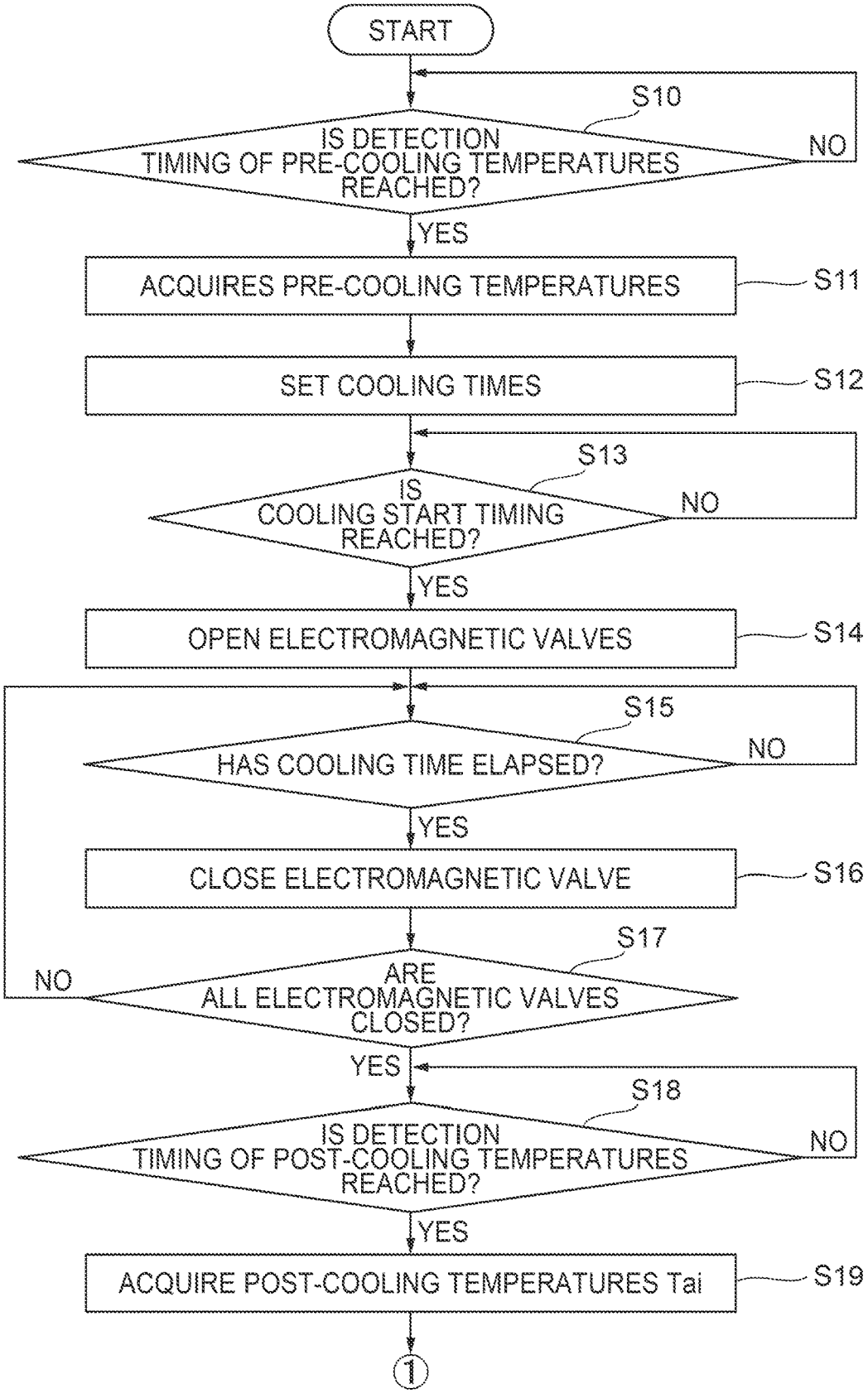
FIG. 6 is a flowchart illustrating part of the procedure of processing executed by a control device of the cooling device according to the embodiment.
Figure 7:
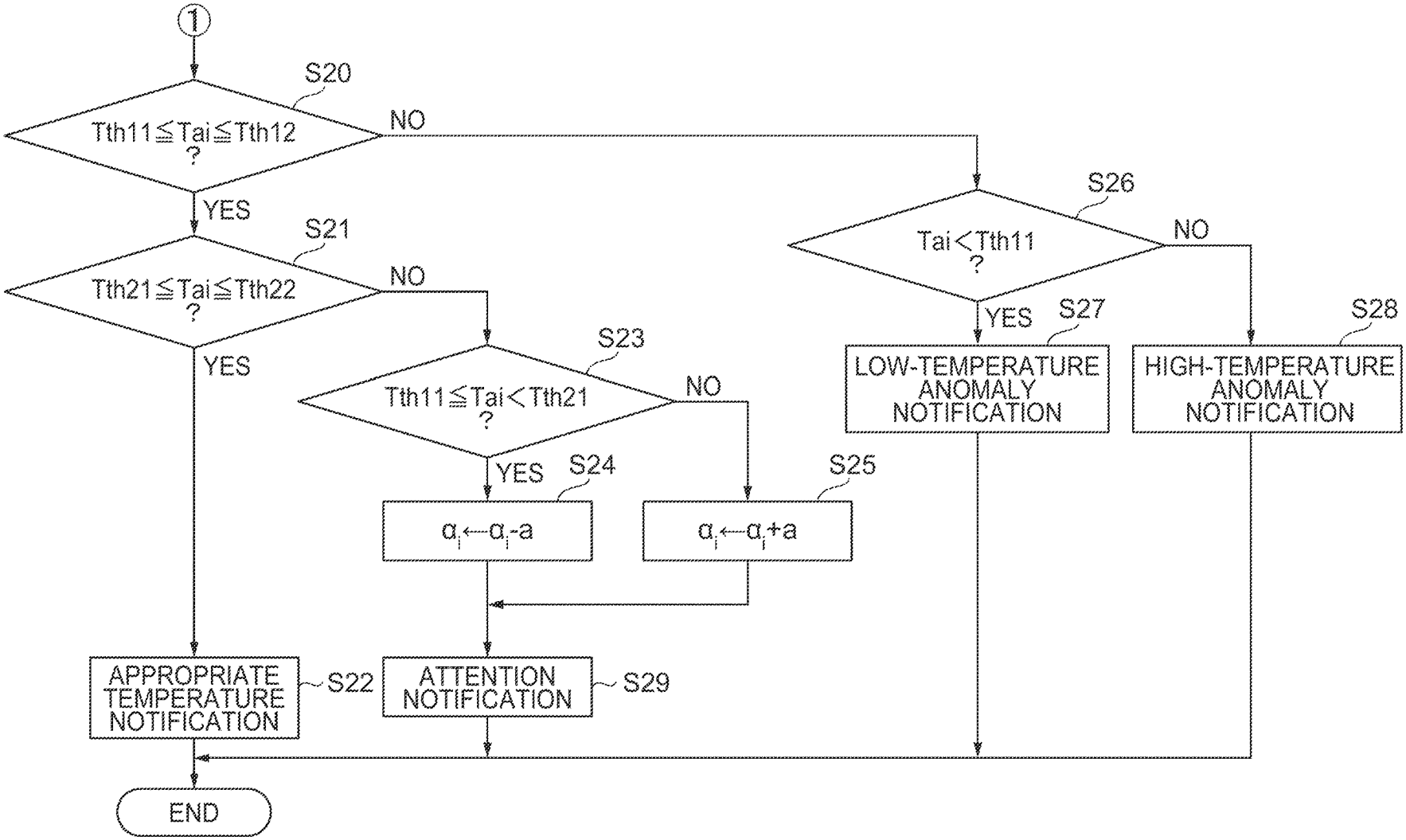
FIG. 7 is a flowchart illustrating part of the procedure of the processing executed by the control device of the cooling device according to the embodiment.

As illustrated in FIG. 6, the temperature information acquisition unit 61 of the control device 60 first determines whether a detection timing of the pre-cooling temperatures $Tb_1$ to $Tb_5$ is reached (step S10). When having recognized the mold 10 preheated by the preheating device 20 has reached the installation places of the radiation thermometers 51 to 55 based on, for example, position information of the mold 10 notified from the manufacturing management device 120 to the control device 60, the temperature information acquisition unit 61 determines that the detection timing of the pre-cooling temperatures $Tb_1$ to $Tb_5$ is reached (YES at step S10). Accordingly, the temperature information acquisition unit 61 acquires the pre-cooling temperatures $Tb_1$ to $Tb_5$ at the first to fifth measurement points $P_1$ to $P_5$ on the mold 10 from the radiation thermometers 51 to 55 (step S11).

Subsequently, the valve control unit 62 sets the cooling times $CT_1$ to $CT_5$ to the first to fifth measurement points $P_1$ to $P_5$ on the mold 10 (step S12). Specifically, the valve control unit 62 calculates a cooling time $CT_i$ from a pre-cooling temperature $Tb_i$, a target temperature $Tt_i$, and a cooling coefficient $\alpha_i$ based on Expression f1 below where "i is 1 to 5". The cooling time $CT_i$ corresponds to a time in which an electromagnetic valve $V_i$ is opened. In the present embodiment, the cooling coefficient $\alpha_i$ correspond to correction parameters.

$$CT_i=(Tb_i-Tt_i)/\alpha_i \quad \text{(f1)}$$

Subsequently, the valve control unit 62 determines whether a cooling start timing of the mold 10 is reached (step S13). When having recognized that the mold 10 is installed on the rollers 43 and 44 based on position information of the mold 10 notified from the manufacturing management device 120 to the control device 60, the roller control unit 63 rotates the rollers 43 and 44 to rotate the mold 10. When the mold 10 is rotated in this manner, the valve control unit 62 determines that the cooling start timing of the mold 10 is reached (YES at step S13). In this case, the valve control unit 62 opens all electromagnetic valves $V_1$ to $V_5$ (step S14) to spray the cooling water from all nozzle parts 313 toward the mold 10, thereby starting cooling of the mold 10. Note that, in the processing at step S14, the valve control unit 62 may open only some of the electromagnetic valves $V_1$ to $V_5$ to cool only part of the mold 10.

Subsequently, the valve control unit 62 determines whether the cooling time $CT_i$ has elapsed since a time point at which the electromagnetic valve $V_i$ is opened (step S15). When having determined that the cooling time $CT_i$ has elapsed, the valve control unit 62 closes the electromagnetic valve $V_i$ (step S16). The processing at steps S15 and S16 is individually executed for all electromagnetic valves $V_1$ to $V_5$. After the processing at step S16, the valve control unit 62 determines whether all electromagnetic valves $V_1$ to $V_5$ are closed (step S17). When having performed the negative determination in the processing at step S17, in other words, when any electromagnetic valve is not closed (NO at step S17), the valve control unit 62 returns to the processing at step S15. Accordingly, the processing at steps S15 and S16 is repeatedly executed until all electromagnetic valves $V_1$ to $V_5$ are closed.

When all electromagnetic valves $V_1$ to $V_5$ are closed, in other words, when cooling of the mold 10 is completed, the valve control unit 62 performs the positive determination in the processing at step S17 (YES at step S17). In this case, the temperature information acquisition unit 61 determines whether a detection timing of the post-cooling temperatures $Ta_1$ to $Ta_5$ is reached (step S18). When having recognized that the cooled mold 10 has reached the installation places of the radiation thermometers 71 to 75 based on, for example, position information of the mold 10 notified from the manufacturing management device 120 to the control device 60, the temperature information acquisition unit 61 determines that the detection timing of the post-cooling temperatures $Ta_1$ to $Ta_5$ is reached (YES at step S18). Accordingly, the temperature information acquisition unit 61 acquires the post-cooling temperatures $Ta_1$ to $Ta_5$ at the first to fifth measurement points $P_1$ to $P_5$ on the mold 10 from the radiation thermometers 71 to 75 (step S19).

Subsequently, as illustrated in FIG. 7, the temperature determination unit 65 determines whether all post-cooling temperatures $Ta_1$ to $Ta_5$ satisfy "$Tth11 \leq Ta_i \leq Tth12$" (step S20). The determination processing at step S20 is processing for determining whether the temperature of the mold 10 is temperature in the temperature range in which the mold wash can be applied. The temperature range in which the mold wash can be applied is set to a range from a correction necessary lower limit value Tth11 lower than the target temperature $Tt_i$ by a predetermined value to a correction necessary upper limit value Tth12 higher than the target temperature $Tt_i$ by the predetermined value with the target temperature $Tt_i$ as the median.

When all post-cooling temperatures $Ta_1$ to $Ta_5$ satisfy "$Tth11 \leq Ta_i \leq Tth12$" (YES at step S20), in other words, when the temperature of the mold 10 is in the temperature range in which the mold wash can be applied, the temperature determination unit 65 determines whether all post-cooling temperatures $Ta_1$ to $Ta_5$ satisfy "$Tth21 \leq Ta_i \leq Tth22$" (step S21). The determination processing at step S21 is processing for determining whether the temperature of the mold 10 is temperature at which the cooling time $CT_i$ needs to be corrected.

Figure 8:
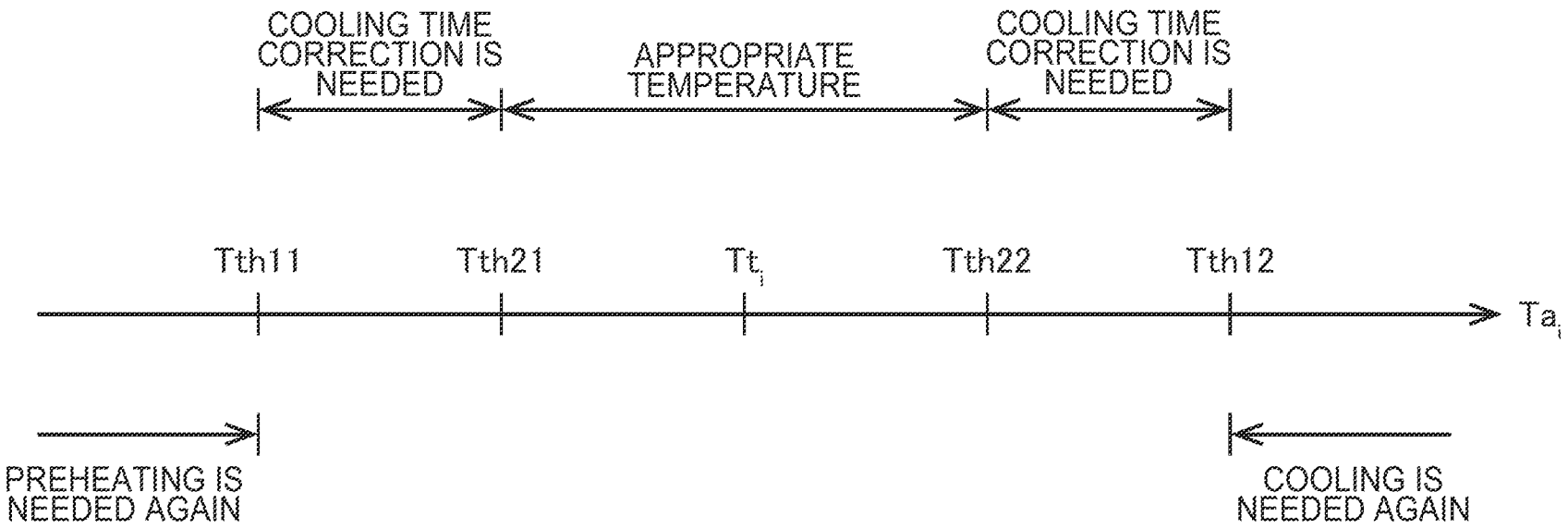
FIG. 8 is a diagram schematically illustrating the relation among a correction necessary lower limit value Tth11, a correction necessary upper limit value Tth12, an appropriate-temperature lower limit value Tth21, and an appropriate-temperature upper limit value Tth22 according to the embodiment.

Specifically, a predetermined appropriate temperature range for determining whether the cooling time $CT_i$ needs to be corrected is set for the post-cooling temperature $Ta_i$ in advance. The appropriate temperature range is set to a range from an appropriate-temperature lower limit value Tth21 lower than the target temperature $Tt_i$ by a predetermined value to an appropriate-temperature upper limit value Tth22 higher than the target temperature $Tt_i$ by the predetermined value with the target temperature $Tt_i$ as the median. The appropriate-temperature lower limit value Tth21 is set to a value higher than the correction necessary lower limit value Tth11. The appropriate-temperature upper limit value Tth22 is set to a value lower than the correction necessary upper limit value Tth12. In other words, as illustrated in FIG. 8, the relation "$Tth11 < Tth21 < Tth22 < Tth12$" is held among the correction necessary lower limit value Tth11, the correction necessary upper limit value Tth12, the appropriate-temperature lower limit value Tth21, and the appropriate-temperature upper limit value Tth22. In the present embodiment, the appropriate temperature range corresponds to a predetermined temperature range. The appropriate-temperature lower limit value Tth21 corresponds to a lower limit temperature threshold value, and the appropriate-temperature upper limit value Tth22 corresponds to an upper limit temperature threshold value.

As illustrated in FIG. 7, when all post-cooling temperatures $Ta_1$ to $Ta_5$ satisfy "$Tth21 \leq Ta_i \leq Tth22$" (YES at step S21), the temperature determination unit 65 determines that the cooling time $CT_i$ does not need to be corrected. In this case, the communication unit 66 notifies the manufacturing management device 120 that the temperature of the mold 10 is appropriate (step S22). Accordingly, the manufacturing management device 120 conveys the mold 10 from the cooling device 21 to the lining device 24 through the cleaning device 22 and the attachment device 23 by using the conveyance device 100. In the present embodiment, this process corresponds to a conveyance process.

When any of the post-cooling temperatures $Ta_1$ to $Ta_5$ does not satisfy "$Tth21 \leq Ta_i \leq Tth22$" (NO at step S21), the temperature determination unit 65 determines that the cooling time $CT_i$ needs to be corrected. In this case, the cooling time correction unit 64 determines whether any of the post-cooling temperatures $Ta_1$ to $Ta_5$ satisfies "$Tth11 \leq Ta_i < Tth21$" (step S23).

When having determined that any of the post-cooling temperatures $Ta_1$ to $Ta_5$ satisfies "$Tth11 \leq Ta_i < Tth21$" (YES at step S23), the cooling time correction unit 64 changes the cooling coefficient $\alpha_i$ in Expression f1 above based on Expression f2 below to shorten the cooling time $CT_i$ at the measurement point $P_i$ corresponding to the post-cooling temperature $Ta_i$ satisfying the condition (step S24). The initial value of the cooling coefficient $\alpha_i$ is set to "1.0", and a correction value a is set to, for example, "0.1".

$$\alpha_i \leftarrow \alpha_i + a \tag{f2}$$

For example, when the post-cooling temperature $Ta_1$ at the measurement point $P_1$ on the mold 10 satisfies "$Tth11 \leq Ta_1 < Tth21$", the temperature at the post-cooling temperature $Ta_1$ is in the temperature range in which the mold wash can be applied but deviates on the low temperature side of the target temperature $Tt_1$. In this case, the cooling coefficients $\alpha_1$ corresponding to the post-cooling temperature $Ta_1$ is changed, for example, from "1.0" to "1.1" based on Expression f2 above, and thus the cooling time $CT_1$ obtained by Expression f1 above is shortened. Accordingly, cooling performance at the measurement point $P_1$ is lowered, and as a result, the temperature at the measurement point $P_1$ becomes higher, in other words, the temperature at the measurement point $P_1$ becomes closer to the target temperature $Tt_1$. In this example, the post-cooling temperature $Ta_1$ at the measurement point $P_1$ corresponding to the cooling time $CT_1$ corresponds to a post-cooling temperature at a predetermined place on the mold 10.

When the cooling time correction unit 64 performs the negative determination in the processing at step S23 (NO at step S23), any of the post-cooling temperatures $Ta_1$ to $Ta_5$ satisfies "$Tth22<Ta_i\leq Tth12$".

For example, when the post-cooling temperature $Ta_1$ satisfies "$Tth22<Ta_i\leq Tth12$", the temperature at the post-cooling temperature $Ta_1$ is in the temperature range in which the mold wash can be applied but deviates on the high temperature side of the target temperature $Tt_1$. Thus, in such a case, it is effective to extend the cooling time $CT_1$ at the measurement point $P_1$ corresponding to the post-cooling temperature $Ta_1$.

When having performed the negative determination in the processing at step S23 (NO at step S23), the cooling time correction unit 64 changes the cooling coefficient $\alpha_i$ in Expression f1 above based on Expression f3 below (step S25).

$$\alpha_i \leftarrow \alpha_i - a \quad \text{(f3)}$$

After the processing at step S24 or step S25 is executed, the communication unit 66 notifies the manufacturing management device 120 that the temperature of the mold 10 needs attention (step S29). In this case, the mold 10 is conveyed from the cooling device 21 to the lining device 24 through the cleaning device 22 and the attachment device 23 by the conveyance device 100 as normal.

When having performed the negative determination in the processing at step S20 (NO at S20), in other words, when any of the post-cooling temperatures $Ta_1$ to $Ta_5$ does not satisfy "$Tth11\leq Ta_i\leq Tth12$", the temperature determination unit 65 determines that the mold wash cannot be applied to the mold 10. In this case, the temperature determination unit 65 determines whether any of the post-cooling temperatures $Ta_1$ to $Ta_5$ satisfies "$Ta_i<Tth11$" (step S26).

When having determined that any of the post-cooling temperatures $Ta_1$ to $Ta_5$ satisfies "$Ta_i<Tth11$" (YES at step S26), the temperature determination unit 65 determines that the temperature of the mold 10 is anomalous to such an extent that the mold wash cannot be applied to the mold 10 because of low temperature. Thus, the communication unit 66 notifies the manufacturing management device 120 of anomaly that the temperature of the mold 10 is too low (step S27). In the present embodiment, the processing at step S27 corresponds to an anomaly detection process.

Having received the low-temperature anomaly notification transmitted from the cooling device 21, the manufacturing management device 120 notifies the worker of the anomaly from the notification device 130. In this case, the worker determines, based on the low-temperature anomaly notification, whether to preheat the low-temperature mold 10 by the preheating device 20 again or directly forward the mold 10 to postprocessing. For example, when the temperature of the mold 10 is lower than a predetermined temperature at which the mold wash can be dried, the worker returns the low-temperature mold 10 to the preheating device 20. When the temperature of the mold 10 is equal to or higher than the predetermined temperature at which the mold wash can be dried, the worker forwards the low-temperature mold 10 to postprocessing. When the mold 10 is forwarded to postprocessing, the low-temperature mold 10 is heated as molten metal is poured into the mold 10 in the molten metal pouring process, and accordingly, the temperature of the mold 10 can be increased to an appropriate temperature. However, the worker discards a cast shaped by the mold 10.

Note that, in the process of returning the low-temperature mold 10 to the preheating device 20, the manufacturing management device 120 may perform processing of conveying the low-temperature mold 10 from the cooling device 21 to the preheating device 20 by using the conveyance device 100.

When the temperature determination unit 65 performs the negative determination in the processing at step S26 (NO at step S26), any of the post-cooling temperatures $Ta_1$ to $Ta_5$ satisfies "$Tth12<Ta_i$". In this case, the temperature determination unit 65 determines that the temperature of the mold 10 is anomalous to such an extent that the mold wash cannot be applied to the mold 10 because of high temperature. Thus, the communication unit 66 notifies the manufacturing management device 120 of anomaly that the temperature of the mold 10 is too high (step S28). In the present embodiment, the processing at step S28 corresponds to the anomaly detection process as well.

Having received the high-temperature anomaly notification transmitted from the cooling device 21, the manufacturing management device 120 stops the production line and notifies the worker of the anomaly from the notification device 130. In this case, the worker applies, based on the high-temperature anomaly notification, a path flag indicating neither lining nor molten metal pouring to be performed to the high-temperature mold 10 and forwards the mold 10 to postprocessing. Accordingly, the high-temperature mold 10 is cooled by the cooling device 21 again without the lining process, the molten metal pouring process, nor the like, and thus the temperature of the mold 10 can be decreased to an appropriate temperature.

Note that, in the process of conveying the high-temperature mold 10 to the cooling device 21, the manufacturing management device 120 may perform processing of conveying the high-temperature mold 10 to the cooling device 21 by using the conveyance device 100.

With the cooling device 21, the manufacturing system 1, and the manufacturing method according to the present embodiment described above, it is possible to obtain effects described in (1) to (4) below.

(1) The control device 60 individually sets each of the cooling times $CT_1$ to $CT_5$ based on the deviation between the corresponding one of the pre-cooling temperatures $Tb_1$ to $Tb_5$ detected at the plurality of measurement points $P_1$ to $P_5$ on the mold 10 by the radiation thermometers 51 to 55 and the corresponding one of the target temperatures $Tt_1$ to $Tt_5$, and controls the electromagnetic valves $V_1$ to $V_5$ based on the set cooling times $CT_1$ to $CT_5$. With this configuration, it is possible to individually manage the cooling times $CT_1$ to $CT_5$ at the measurement points $P_1$ to $P_5$ on the mold 10 while spraying the cooling water from the plurality of nozzle parts 313. Accordingly, it is possible to individually control the degrees of cooling at the plurality of measurement points $P_1$ to $P_5$ on the mold 10, and thus it is possible to more uniformly cool the mold 10.

(2) As illustrated in FIG. 3, the electromagnetic valves $V_1$ to $V_5$ are provided at the plurality of respective bifurcation pipes 311*a* to 311*e* of the cooling water supplying tube 31. With this configuration, it is possible to easily switch spraying of the cooling water from the nozzle parts 313 and stop of the spraying through opening and closing operations of the electromagnetic valves $V_1$ to $V_5$.

(3) As illustrated in FIGS. 6 and 7, the control device 60 sets the cooling coefficient $\alpha_i$ based on the post-cooling temperature $Ta_i$ of the mold 10 detected by the radiation thermometers 71 to 75, and corrects the cooling time $CT_i$ by using the set cooling coefficient $\alpha_i$. Specifically, when the post-cooling temperature $Ta_i$ of the mold 10 is higher than the appropriate-temperature upper limit value Tth22, the control device 60 sets the cooling coefficient $\alpha_i$ so that the cooling time $CT_i$ is corrected to be longer. When the post-cooling temperature $Ta_i$ of the mold 10 is lower than the appropriate-temperature lower limit value Tth21, the control device 60 sets the cooling coefficient $\alpha_i$ so that the cooling time $CT_i$ is corrected to be shorter. With this configuration, it is possible to perform feedback correction of the cooling time $CT_i$, and thus it is possible to more accurately adjust the temperature of a mold 10 flowing next closer to the target temperature $Tt_i$.

(4) When all post-cooling temperatures $Ta_1$ to $Ta_5$ of the mold 10 satisfy "$Tth11 \leq Ta_i \leq Tth12$", the manufacturing management device 120 conveys the mold 10 to the lining device 24 by using the conveyance device 100. When any of the post-cooling temperatures $Ta_1$ to $Ta_5$ is lower than the appropriate-temperature lower limit value Tth11 or when any of the post-cooling temperatures $Ta_1$ to $Ta_5$ is higher than the appropriate-temperature upper limit value Tth12, the manufacturing management device 120 detects temperature anomaly of the mold 10. With this configuration, it is possible to detect temperature anomaly of the mold 10 when the temperature of the mold 10 after cooling is too low or too high, and thus, and thus it is possible to more accurately manage the temperature of the mold 10 proceeding to postprocessing of the cooling device 21.

Note that the above-described embodiment may be performed in forms described below.

The method of correcting the cooling time $CT_i$ is not limited to the method of dividing the deviation between the pre-cooling temperature $Tb_i$ and the target temperature $Tt_i$ by the cooling coefficient $\alpha_i$ but may be an optional correction method such as the method of multiplying the deviation by a coefficient or the method of adding or subtracting a constant to or from the deviation. In other words, the control device 60 only needs to correct the cooling time $CT_i$ based on the post-cooling temperature $Ta_i$ of the mold 10.

The interval and number of the nozzle parts 313 provided at the pipe portions 312*a* to 312*e* are optionally changeable. In addition, the disposition of the nozzle parts 313 at the pipe portions 312*a* to 312*e* is changeable as appropriate. For example, in each of the pipe portions 312*a* to 312*e*, the nozzle parts 313 may be disposed alongside in a direction at a predetermined angle relative to the central axis m10 of the mold 10, or the nozzle parts 313 may be disposed alongside in two lines or more. Moreover, the disposition lengths of the pipe portions 312*a* to 312*e* are optionally changeable as well.

The positions and number of the measurement points $P_1$ to $P_5$ set on the mold 10 are optionally changeable.

The cooling device 21 may use thermometers of an optional non-contact scheme such as thermography in place of the radiation thermometers 51 to 55 and 71 to 75.

The valve control unit 62 of the control device 60 may change the cooling times $CT_1$ to $CT_5$ not only by opening and closing the electromagnetic valves $V_1$ to $V_5$ but also by optionally adjusting the opening degree of each electromagnetic valve to an intermediate opening degree between a fully closed state and a fully opened state.

As for movement of the mold 10 between the preheating process, the cooling process, the cleaning process, the attachment process, the lining process, the molten metal pouring process, the removal process, and the pullout process, the worker may transport the mold 10 instead of the method of using the conveyance device 100.

The pump for pressurized transfer of the cooling water may be provided at each of the bifurcation pipes 311*a* to 311*e* instead of the main pipe 310.

The present disclosure is not limited to the above-described specific examples. Those obtained by adding designing change to the above-described specific examples as appropriate by the skilled person in the art are also included in the scope of the present disclosure as long as they have the features of the present disclosure. Elements included in the above-described specific examples, and their disposition, conditions, shapes, and the like are not limited to those exemplarily described but may be changed as appropriate. Combination of elements included in the above-described specific example may be changed as appropriate without technological inconsistency.

What is claimed is:

1. A mold cooling device configured to cool a cylindrical mold used for centrifugal casting, the mold cooling device comprising:

a temperature detection unit configured to detect temperatures at a plurality of respective places on the mold;

a plurality of spraying units disposed alongside one another in a direction parallel to a central axis of the mold and configured to spray a cooling medium to the mold;

a plurality of switching units configured to switch spraying states of the cooling medium from the plurality of spraying units; and a control unit configured to control the plurality of switching units, wherein the temperature detection unit detects pre-cooling temperatures that are temperatures at the plurality of respective places on the mold before the cooling medium is sprayed from the plurality of spraying units to the mold, and when a cooling time is a time from a time point at which the cooling medium is sprayed from the spraying units to a time point at which spraying of the cooling medium is stopped, the control unit individually sets the cooling time to each of the plurality of places on the mold based on a deviation between a pre-cooling temperature detected at a place on the mold by the temperature detection unit and a target temperature and controls the plurality of switching units based on cooling times individually set to the plurality of respective places on the mold.

2. The mold cooling device according to claim 1, further comprising a cooling medium supplying tube that supplies the cooling medium to the plurality of spraying units, wherein the cooling medium supplying tube includes a main pipe through which the cooling medium flows, and a plurality of bifurcation pipes bifurcated from the main pipe and supplying the cooling medium to the plurality of respective spraying units, and the plurality of switching units are provided at the plurality of respective bifurcation pipes.

3. The mold cooling device according to claim 1, wherein the temperature detection unit further detects post-cooling temperatures that are temperatures at the plurality of respective places on the mold after the cooling medium is sprayed from the plurality of spraying units to the mold, and the control unit sets correction parameters based on a post-cooling temperature detected at the plurality of respective places on the mold by the temperature detection unit and corrects the cooling times individually set to the plurality of respective places on the mold with the correction parameters.

4. The mold cooling device according to claim 3, wherein when the post-cooling temperature at a predetermined place among the plurality of places on the mold is higher than a predetermined temperature range determined based on the target temperature, the control unit sets the correction parameters so that the cooling time corresponding to the predetermined place is corrected to be longer, and when the post-cooling temperature at the predetermined place on the mold is lower than the predetermined temperature range, the control unit sets the correction parameters so that the cooling time corresponding to the predetermined place is corrected to be shorter.

5. A cast manufacturing system configured to manufacture a cylindrical cast by using a centrifugal casting method, the cast manufacturing system comprising:

a cooling device configured to cool the mold;

a lining device configured to apply mold wash to the cooled mold;

a molten metal pouring device configured to pour molten metal into the mold to which the mold wash is applied;

a conveyance device configured to convey the mold; and a control device configured to control the conveyance device, wherein the cooling device according to claim 4 is used as the cooling device, a lower limit temperature threshold value is set as a temperature lower than a lower limit value of the predetermined temperature range, and an upper limit temperature threshold value is set as a temperature higher than an upper limit value of the predetermined temperature range, when the post-cooling temperature at each of the plurality of places on the mold is equal to or higher than the lower limit temperature threshold value and equal to or lower than the upper limit temperature threshold value, the control device of the conveyance device conveys the mold to the lining device by using the conveyance device, and when the post-cooling temperature at any of the plurality of places on the mold is lower than the lower limit temperature threshold value or when the post-cooling temperature at any of the plurality of places on the mold is higher than the upper limit temperature threshold value, the control device of the conveyance device detects temperature anomaly of the mold.

6. A cast manufacturing method of manufacturing a cylindrical cast by using a centrifugal casting method, the cast manufacturing method comprising:

a cooling process of cooling a mold;

a lining process of applying mold wash to the cooled mold; and a molten metal pouring process of pouring molten metal into the mold to which the mold wash is applied, wherein the cooling process is performed by using the cooling device according to claim 4, a lower limit temperature threshold value is set as a temperature lower than a lower limit value of the predetermined temperature range, and an upper limit temperature threshold value is set as a temperature higher than an upper limit value of the predetermined temperature range, and processes performed after the cooling process is completed include;

a conveyance process of conveying the mold to the lining process when the post-cooling temperature each of the plurality of places on the mold is equal to or higher than the lower limit temperature threshold value and equal to or lower than the upper limit temperature threshold value, and an anomaly detection process of detecting temperature anomaly of the mold when the post-cooling temperature at any of the plurality of places on the mold is lower than the lower limit temperature threshold value or when the post-cooling temperature at any of the plurality of places on the mold is higher than the upper limit temperature threshold value.

* * * * *